United States Patent [19]

Kiefer et al.

[11] Patent Number: 4,894,873

[45] Date of Patent: Jan. 23, 1990

[54] WAVE SUPPRESSION MEANS

[76] Inventors: Jack K. Kiefer, 3710 Lawson Rd., Glenview, Ill. 60025; Dale A. Kiefer, 15323 Bestor Blvd., Pacific Palasades, Calif. 90272; Roger Eddy, 3101 Fernwood La., New Castle, Pa. 16105

[21] Appl. No.: 184,338

[22] Filed: Apr. 21, 1988

[51] Int. Cl.[4] ..... E04H 3/16

[52] U.S. Cl. ..... 4/497; 4/505; 441/133

[58] Field of Search ..... 4/496, 497, 505; 441/133

[56] References Cited

U.S. PATENT DOCUMENTS

| | | | |
|---|---|---|---|
| 3,304,560 | 2/1967 | Kiefer | 4/497 |
| 3,332,093 | 7/1967 | Skinner et al. | 441/133 |
| 3,540,063 | 11/1970 | Stanwood | 4/497 |
| 3,755,829 | 9/1973 | Walklet | 4/497 |
| 3,757,370 | 9/1973 | Seno et al. | 441/133 |
| 3,786,521 | 1/1974 | Walket | 4/497 |
| 3,793,657 | 2/1974 | Kaas | 441/133 |
| 3,886,602 | 5/1975 | Stanwood | 4/497 |
| 4,048,677 | 9/1977 | Kajlich | 4/497 |
| 4,052,755 | 10/1977 | Baker | 4/497 |
| 4,616,369 | 10/1986 | Rademacher | 4/497 |

*Primary Examiner*—Henry J. Recla
*Assistant Examiner*—Robert M. Fetsuga
*Attorney, Agent, or Firm*—Reed Smith Shaw & McClay

[57] ABSTRACT

A wave suppression device, for use suppressing waves and for use in the demarcation of swimming pool lanes, comprised of a cylindrical core having a plurality of fins radially extending from its outer surface. The fins are positioned substantially coextensively along the length of the core. At least one spacer is circumferentially positioned about and connected to the core member and fins. A flotation assembly is axially positioned within the core member and compression fit against the inner surface thereof. The flotation assembly includes a central axial opening for receiving a cable or like device for stringing a plurality of wave suppression devices together to form a lane demarcation.

5 Claims, 3 Drawing Sheets

WAVE SUPPRESSION MEANS

FIELD OF THE INVENTION

The present invention relates a means for suppressing waves and, in particular, to waves formed by swimmers which can be used for marking swimming lanes in competitive swimming meets.

BACKGROUND OF THE INVENTION

The use of wave suppressors is generally well known. For example in U.S. Pat. No. 3,304,560 a turbulence reducing device is shown in which a plurality of lattice devices are strung the length of the swimming pool. Float means are attached to the ends of each of the devices to maintain buoyancy if the device is formed of a nonbuoyant material. This suppressor was one of the earliest attempts to suppress wave transmission between swimming lanes.

Numerous other devices have also been proposed to better suppress turbulence in competitive swimming pools, e.g., U.S. Pat. Nos. 3,540,063; 3,755,829; 3,786,521; 4,048,677 and 4,052,755. In general, these "racing lanes" consist of a plurality of elements strung on a cable that extends the length of the pool to define the boundaries of the swimming lanes. Each element is configured as a particular axially symmetric shape designed to suppress or inhibit the propagation of waves generated by a swimmer into the lane of another swimmer. Of these, U.S. Pat. No. 3,755,829 has found commercial success in the marketplace.

Another such device of particular interest is disclosed in U.S. Pat. No. 3,886,602. The device disclosed has a plurality of discs positioned perpendicular to the cable and is manufactured from a foamed plastic so that each element is capable of floating without separate flotation means. This device overcame many of the objections of the prior art devices which do little more than mark the lanes. However, because of its size and shape it permitted the majority of waves energy to pass from one pool lane to another. Additionally, it was difficult to handle and store and expensive to manufacture.

Unlike previous suppression elements, the wave suppressor of the present invention is the result of extensive hydrodynamic experimentation and testing. The shape of the novel element specifically disrupts the circular motion of water parcels that define the wave and leads to its propagation. This shape traps water motion into enclosures thus creating random turbulent motion which is quickly dissipated by the viscous forces of water itself. It is contemplated that the suppressor design of the present invention not suppress waves between lanes, but can be used in other applications such as breakers around swimming or harbor areas.

Further, the suppressor of the present invention can be sized to match and suppress the waves generated by a swimmer or ships and the like. A swimmer, for example, generates a wave of sufficiently long wavelength so that they are not effectively blocked by the existing sizes of lane elements. Also, the lane element, which is manufactured in plastic with integral flotation, to have a density of ½ that of water, and thus floats half submerged. Accordingly, it is an object of the present invention to provide an improved wave suppression means which overcomes the deficiencies of the prior art.

SUMMARY OF THE INVENTION

In general, the present invention provides a wave suppression element which is comprised of a cylindrical core having a plurality of fins radiating therefrom and which extend substantially the length of the core. At least one spacer member of disk is provided interconnecting and supporting the fins. The combination of fins and spacer define wave entrapment cavities. Coextensively within the core is an opening for placing a cable or other securing means in which a plurality elements may be strung. In a preferred embodiment, an integral flotation means having an opening therethrough for mounting the element on to a cable is coextensively positioned through the core. In the preferred embodiment, the flotation means is preferably comprised of a pair of compression fit, semi-cylindrical floats, each containing sufficient air to provide buoyancy to the lane elements such that when a plurality of such elements are strung on cable, the elements are half submerged.

In a preferred embodiment the wave suppression members are molded, either by blow molidng techniques or by injection molding into three separate parts. The two integral flotation elements are compression fit within the core immediately after molding.

It has been found in tests with the present invention that the principle waves generated by a swimmer range between 0.6 and 1.6 meters in wavelength and generally have an amplitude less than 7 cm. The longer the wavelengths, however, the more difficult it is to dissipate or suppress the energy. In comprehensive testing described hereinafter, it has been found that most prior art wave suppression devices are effective in suppressing waves having a wavelength of less than 0.3 m. But, as the wavelengths increase in size, these devices are less and less effective.

In wave suppression, the present invention has been found to dissipate up to 70% of the longer wavelength waves whereas the leading prior art device was only 25% effective. Other advantages of the invention will become apparent from a perusal of the following detailed description of a presently preferred embodiment of the invention.

PRESENTLY PREFERRED EMBODIMENT OF THE INVENTION

Figure 1:
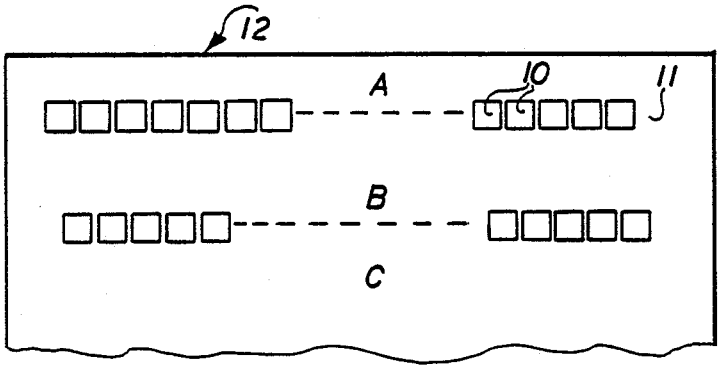
FIG. 1 is a partial elevation of a swimming pool showing the invention functioning as lane dividers.

Referring to FIG. 1, a plurality of wave suppression elements 10 of the present invention are shown strung on cable 11 across a pool 12 to divide the pool into various lanes A, B, C, et cetera. Larger elements 10 can be strung around a swimming area or harbor, for example, to protect it from ocean waves or waves generated by ship movement adjacent to the protected areas. However, the present invention will be described with reference to use in swimming pools.

Figure 2:
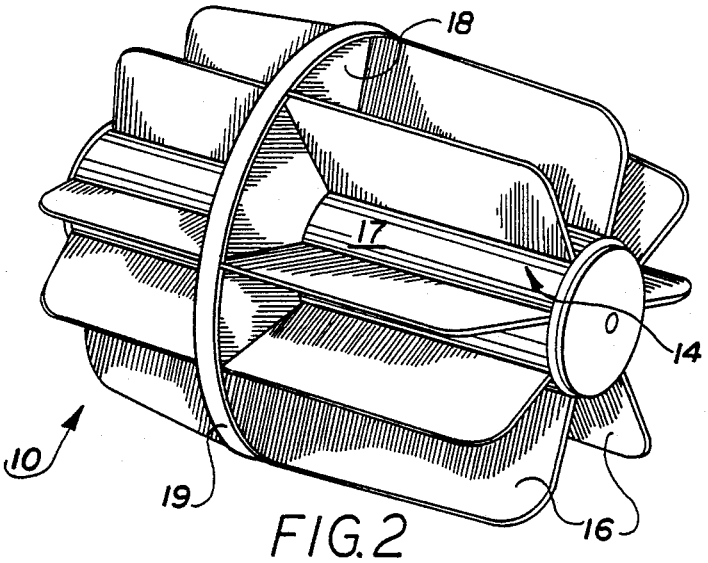
FIG. 2 is perspective view of the wave suppression element of the present invention.
Figure 3:
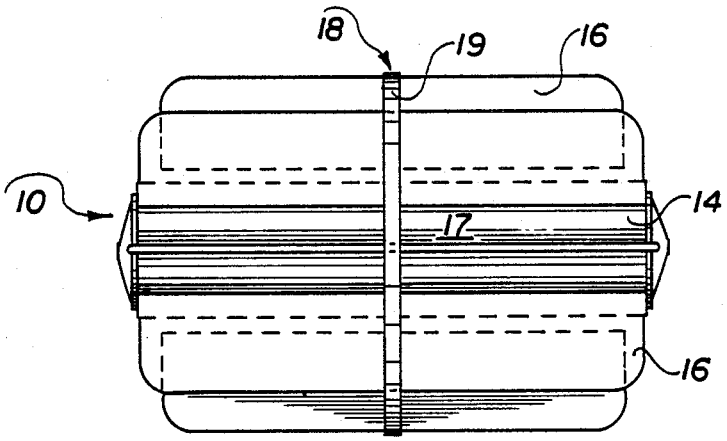
FIG. 3 is a side elevation of the wave suppression element.

As shown in FIGS. 2 and 3, the presently preferred embodiment of wave suppression element 10 comprises a cylindrical core 14. Core 14 includes a plurality of radially extending fins 16 extending from outer surface 17. At least one spacer member 18 is positioned perpendicular to and circumferentially of core 14 to define a plurality of wave entrapment cavities. Spacer member 18 includes a peripheral flange 19.

Spacer member 18 provides support to fins 16 in their relative positions as well as imparting wave deflection and entrapment as they impact the fins and core of lane element 10. In the presently preferred embodiment, it has been found necessary to utilize only one such spacer member on core 14. As shown, this member is positioned midway along the length of core 14 so as to bifurcate and float into two segments. However, more than one spacer may be useful for larger wave suppressor elements for more effective entrapment of the circular wave patterns. Presently, one or two spacers have been found suitable for optimum wave energy dissipation.

Figure 4:
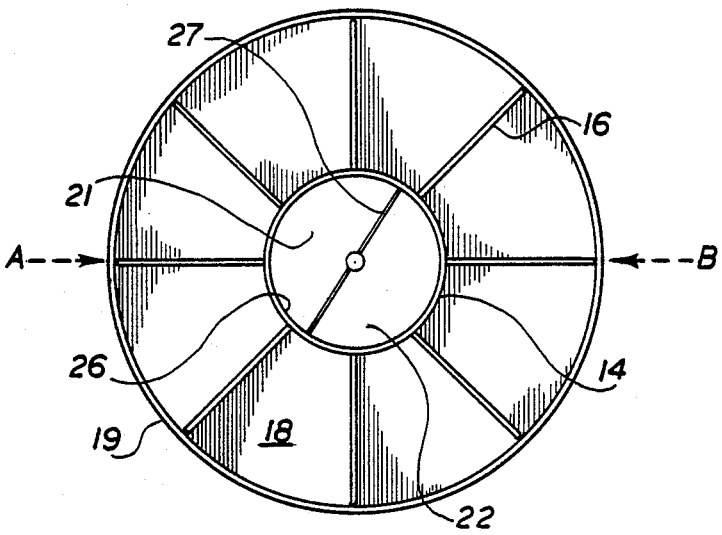
FIG. 4 is an end view of the element shown in FIG. 3.
Figure 5:
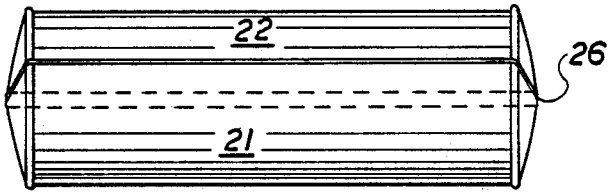
FIG. 5 is a side elevation of the assembled pair of flotation members prior to insertion in the core element of the invention.
Figure 6:
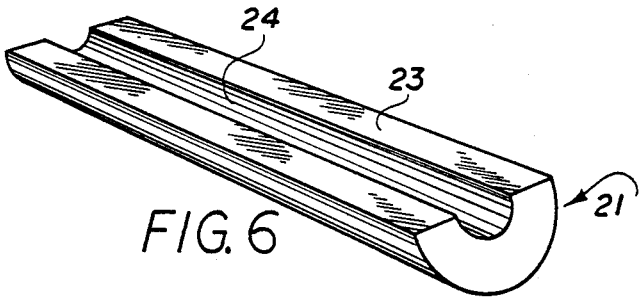
FIG. 6 is perspective view of one of the flotation members.

With reference to FIGS. 4 through 6, flotation of wave suppression element 10 is maintained by means of float members 21 and 22. As shown more particularly in FIG. 6, each of the float members comprises a semicylindrical body 23 having channel 24 integrally formed therein. The edges of body 23 are sealed and render the interior thereof water tight. The two members are compression fit within the inner wall 26 of core element 14 to define the flotation member. The formed channels 24 define opening 27 through which cable 11 passes.

The air contained in float members 21 and 22 is sufficient to support lane element 10 within the water along line A-B of FIG. 4. That is, in the preferred embodiment lane element 10 is approximately 50% submerged so that it can effectively dissipate wave motion above and below the water line.

Figure 7:
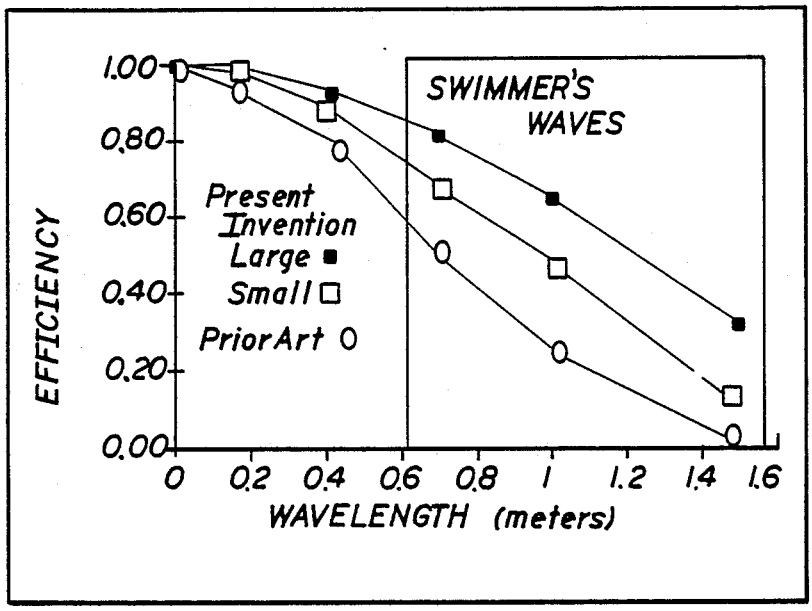
FIG. 7 is a graphical representation of the energy dissipation efficiency of the present invention compared to a prior art wave suppression means.

Tests were performed with wave suppression elements of the present invention which were compared with the leading wave suppression floats similar to U.S. Pat. No. 3,755,829. Two different sized lane elements 10 were used, an element having a support member 18 diameter of 15 cm and a smaller element having a diameter of 11 cm. The test was conducted in a wave tank in which a wave generator created various wavelength waves. Detectors measured the incident wave so generated and the wave passing through the tested wave suppressors. The results of these tests are shown graphically on FIG. 7, where the efficiency of wave dissipation by the wave suppressors is equal to one minus the ratio of the suppressed wave to incident wave energy. For longer wave lengths, proportionally larger diameters are required.

In the presently preferred embodiment of the invention, it preferred that each wave suppression element be injection molded polymer. The flotation members 21 and 22 are flow molded so as to provide an air tight seal. Flotation members 21 and 22 subsequently compression fit within core member 14. As set forth above, various diameters can be utilized, the somewhat larger diameter being more effective for the longer wavelength waves which range from 0.6 to 1.6 meters for most swimmers.

While a presently preferred embodiment of the invention has been shown and described in particularly, the invention may be otherwise embodied within the scope of the appended claims.

What is claimed is:

1. A wave suppression means for use in the demarcation of swimming pool lanes comprised of a. a cylindrical core member having an inner and outer surface and including
   i. a plurality of fins radially extending from its outer surface and positioned substantially coextensively along the length of said core members;
   ii. at least one space member circumferentially positioned about and connected to said core member and fins; and
b. a flotation means axially positioned within said core member and compression fit against its inner surface, said flotation means including a central axial opening for receiving a means for stringing a plurality of wave suppression means together to form a lane demarcation.

2. A wave suppression means as set forth in claim 1, wherein the core member includes at least eight fins.

3. A wave suppression means as set forth in claim 1 or 3, wherein said flotation means is comprised of a pair of mirror, half cylindrical flotation members having an annular axial channel for forming a central opening therethrough.

4. A wave suppression means as set forth in claim 2 or 3, wherein said spacer member is positioned so as to bifurcate the suppression means into two substantially equal segments.

5. A wave suppression means as set forth in claim 4, wherein said spacer member includes a circumferential flange having an outer diameter slightly greater than the outside diameter of the wave suppression means.

* * * * *

UNITED STATES PATENT AND TRADEMARK OFFICE

CERTIFICATE OF CORRECTION

PATENT NO. : 4,894,873

DATED : January 23, 1990

INVENTOR(S) : Jack K. Kiefer, Dale A. Kiefer and Roger Eddy

It is certified that error appears in the above-identified patent and that said Letters Patent is hereby corrected as shown below:

At Column 2, line 7, after "member" delete "of" and substitute therefor -- or --.

At Column 4, line 10, after "are" delete "flow" and substitute therefor -- blow --.

At Column 4, line 17, after "in" delete "particularly" and substitute therefor -- particularity --.

At Column 4, line 27, after "core" delete "members" and substitute therefor -- member --.

Signed and Sealed this

Twelfth Day of May, 1992

*Attest:*

*Attesting Officer*

DOUGLAS B. COMER

*Acting Commissioner of Patents and Trademarks*